US010315836B2

(12) United States Patent
Zabloski

(10) Patent No.: US 10,315,836 B2
(45) Date of Patent: Jun. 11, 2019

(54) METHODS, USES, AND APPARATUS FOR PRESENTING AND STORING OBJECTS

(71) Applicant: Matthew James Zabloski, Calgary (CA)

(72) Inventor: Matthew James Zabloski, Calgary (CA)

(73) Assignee: Matthew James Zabloski, Calgary, Alberta (CA)

( * ) Notice: Subject to any disclaimer, the term of this patent is extended or adjusted under 35 U.S.C. 154(b) by 0 days.

(21) Appl. No.: 15/788,317

(22) Filed: Oct. 19, 2017

(65) Prior Publication Data

US 2019/0119035 A1 Apr. 25, 2019

(51) Int. Cl.
*B65D 85/00* (2006.01)
*B65D 8/00* (2006.01)

(52) U.S. Cl.
CPC ..... *B65D 85/70* (2013.01); *B65D 7/04* (2013.01); *B65D 9/02* (2013.01)

(58) Field of Classification Search
CPC . A47G 19/30; B65D 7/04; B65D 9/02; B65D 21/02; B65D 21/0233; B65D 21/08; B65D 25/54; B65D 83/04; B65D 85/00; B65D 85/70
USPC ..... 206/385, 735, 736, 758, 761, 765–774; 220/23.83, 23.86; 221/277
See application file for complete search history.

(56) References Cited

U.S. PATENT DOCUMENTS 2,252,381 A * 8/1941 Ladd ..... A24F 15/06 206/804
5,653,338 A * 8/1997 Tani ..... A45D 40/04 206/385
5,868,266 A * 2/1999 Nobakht ..... A47G 19/30 206/804
6,086,376 A * 7/2000 Moussa ..... A61K 9/008 424/450
6,905,272 B2 * 6/2005 Yamanaka ..... A45D 40/04 401/75
8,079,499 B2 * 12/2011 Juteau ..... B65D 83/0011 401/175
8,100,260 B1 * 1/2012 Weckerle ..... A45D 40/065 206/385
8,113,350 B2 * 2/2012 Sanchez ..... A45D 40/00 206/1.5

(Continued)

*Primary Examiner* — Bryon P Gehman
(74) *Attorney, Agent, or Firm* — Gowling WLG (Canada) LLP

(57) ABSTRACT

A container for presenting and storing an object comprises a base and a shell with a first end and second end. The first end is operatively coupled to the base so the shell is rotatable relative thereto. The second end defines an aperture opposite to the base. The container includes a carriage that is received within the shell and that is configured to translate between a presentation position proximal to the aperture and a storage position distal to the aperture. The container includes an actuatable member, which is adjacent to the aperture, and which is configurable between an open position and a closed position. Rotation of the base relative to the shell, in a first direction, opens the actuatable member and the carriage moves towards the presentation position. Rotation in a second direction closes the actuatable member and moves the carriage towards the storage position.

13 Claims, 7 Drawing Sheets

(56) References Cited

U.S. PATENT DOCUMENTS

| | | | | |
|---|---|---|---|---|
| 8,157,114 | B2 * | 4/2012 | Baylous | B65D 83/0011<br>401/175 |
| 8,523,013 | B2 * | 9/2013 | Sines | B65D 21/08<br>221/135 |
| 9,896,260 | B2 * | 2/2018 | Sines | B65D 81/22 |

* cited by examiner

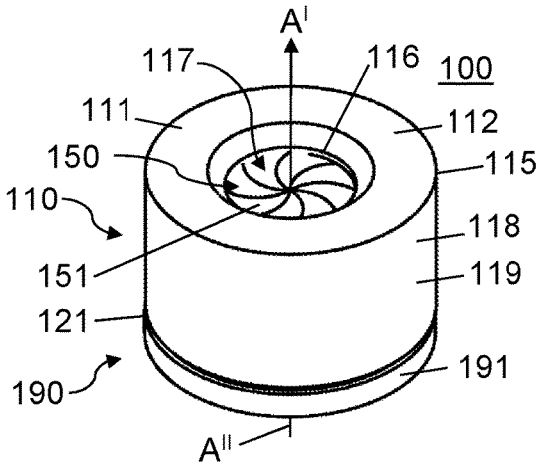
FIG. 1A
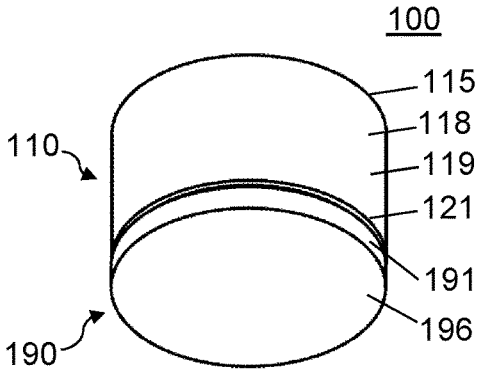
FIG. 1B
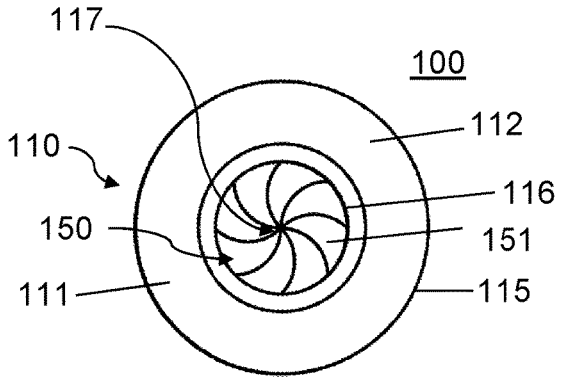
FIG. 1C
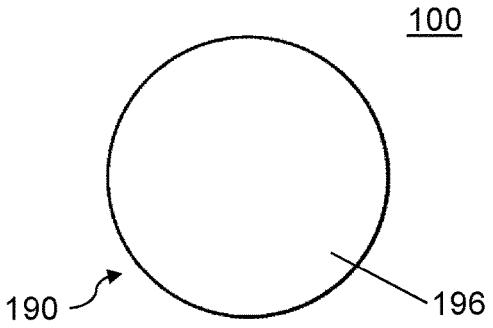
FIG. 1D
FIG. 1

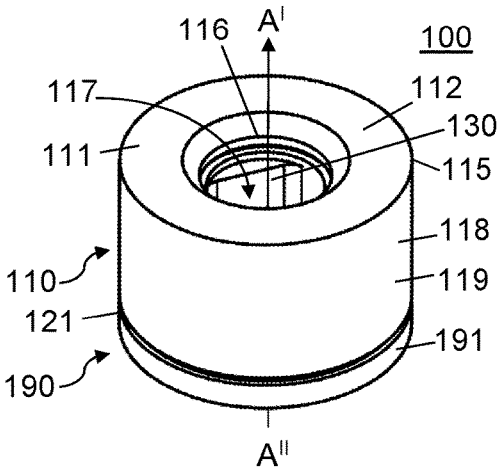
FIG. 2A
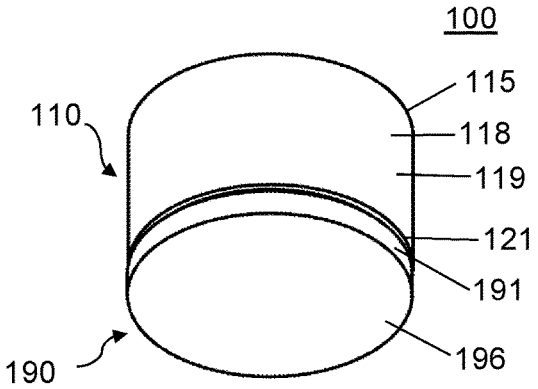
FIG. 2B
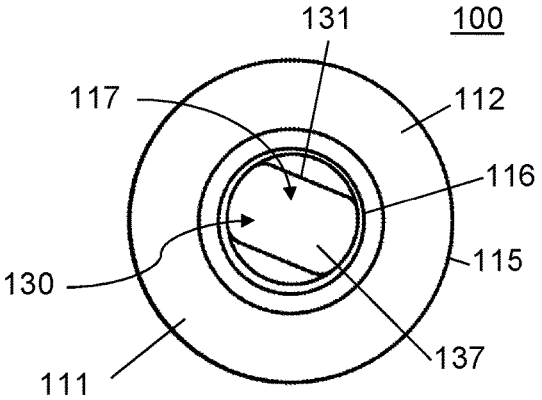
FIG. 2C
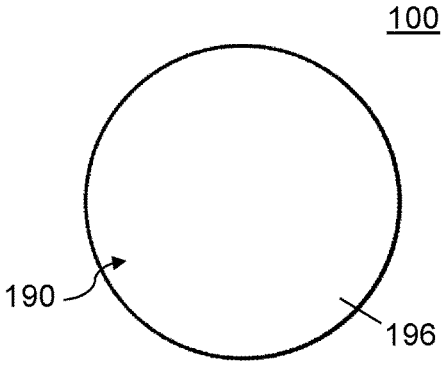
FIG. 2D
FIG. 2

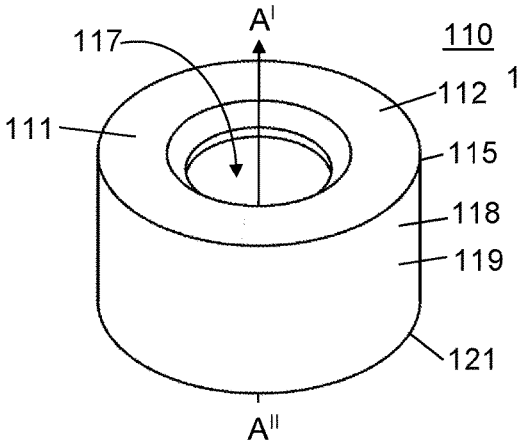
FIG. 3A
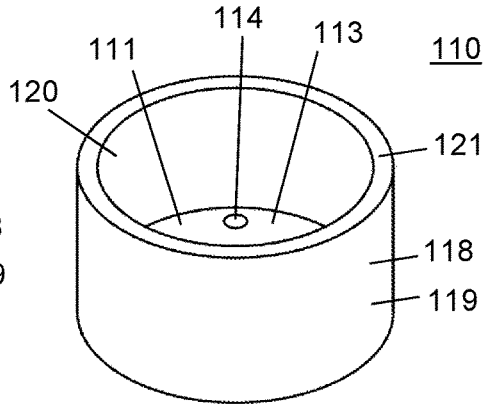
FIG. 3B
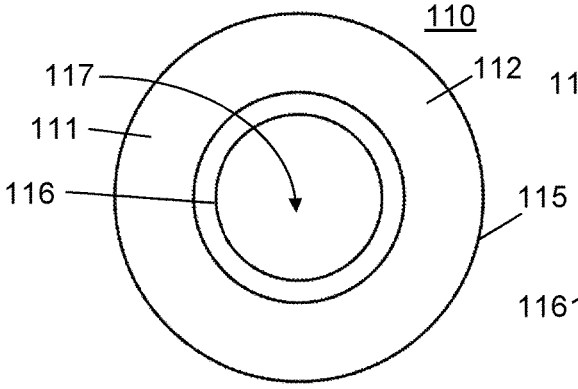
FIG. 3C
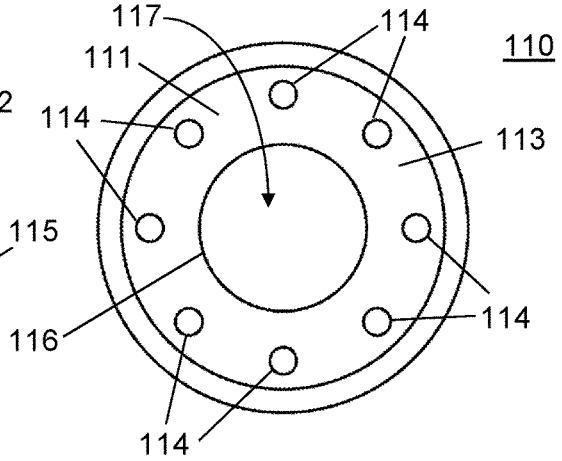
FIG. 3D
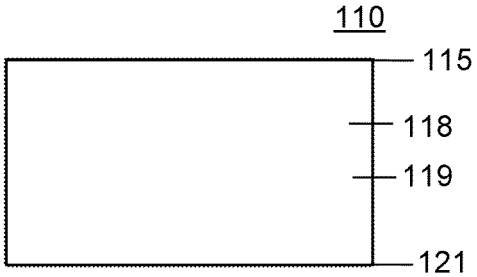
FIG. 3E
FIG. 3

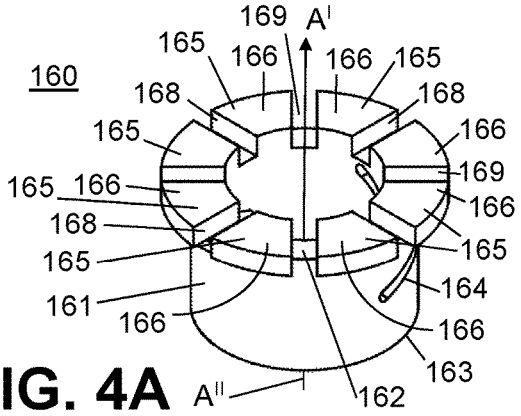
FIG. 4A
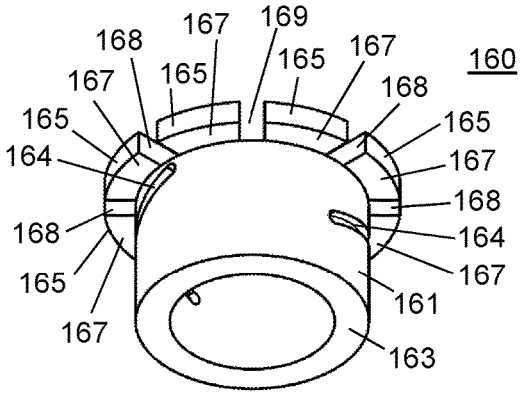
FIG. 4B
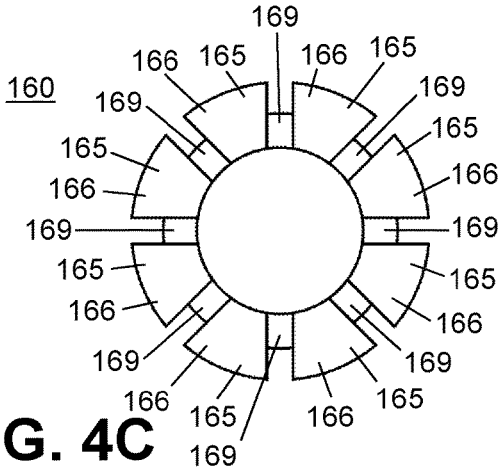
FIG. 4C
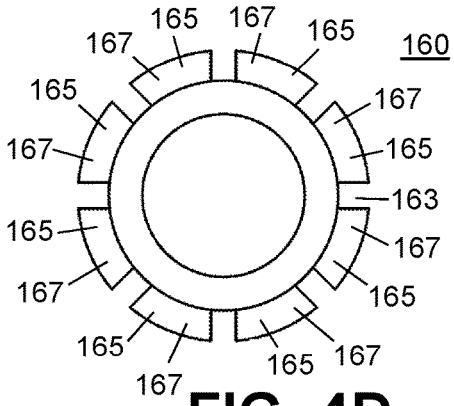
FIG. 4D
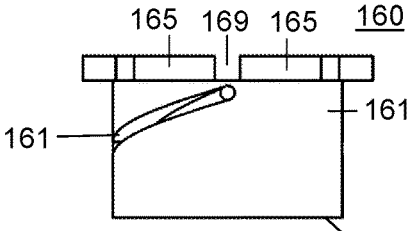
FIG. 4E
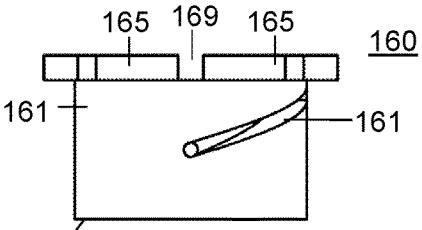
FIG. 4F
FIG. 4

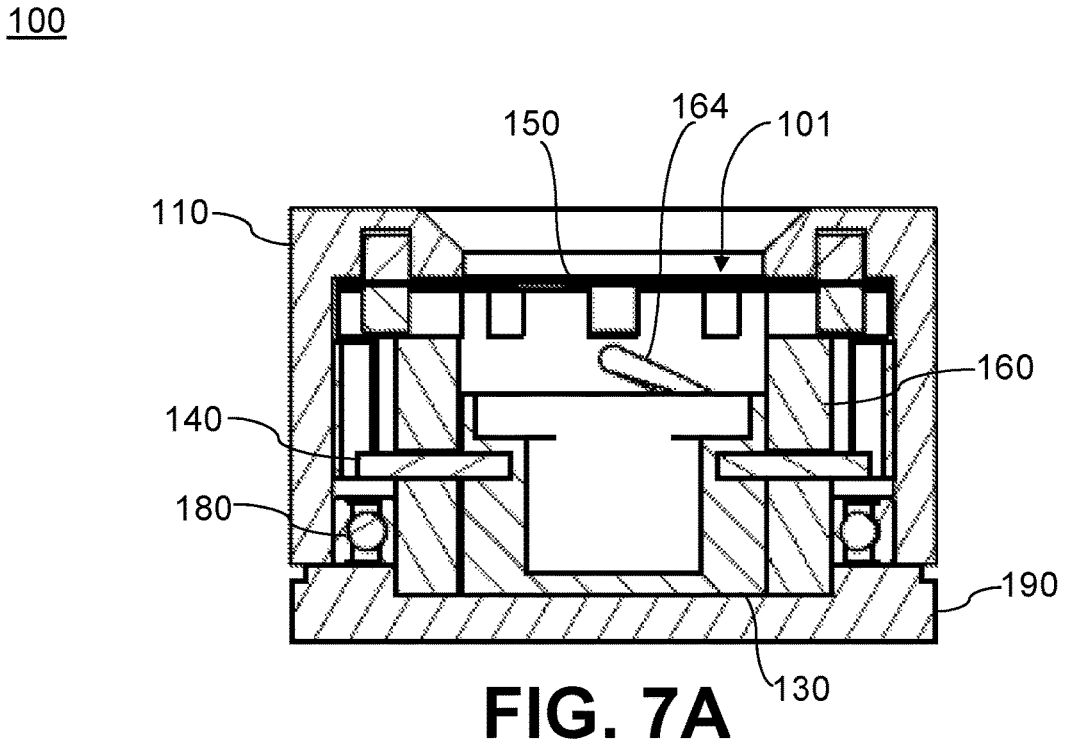
FIG. 7A
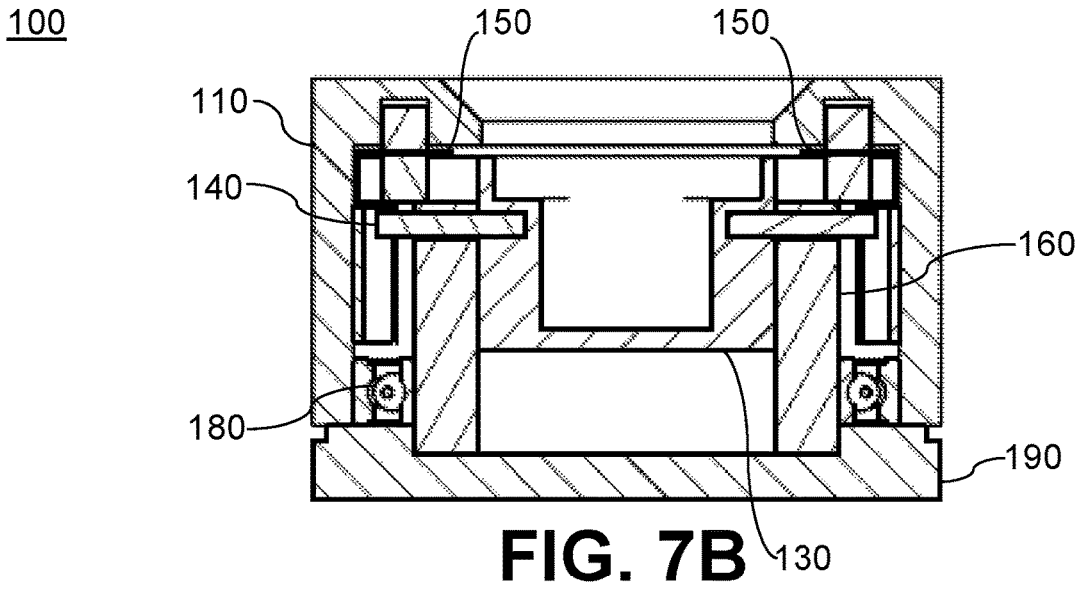
FIG. 7B
FIG. 7

METHODS, USES, AND APPARATUS FOR PRESENTING AND STORING OBJECTS

TECHNICAL FIELD

The present disclosure generally relates to apparatus for presenting and storing personal ornaments. In particular, the disclosure relates to container that utilizes one or more mechanical arrangements for presenting and storing objects.

BACKGROUND

Objects—such as rings, bracelets, brooches, jewels, pendants, watches, necklaces and the like—are often provided in an accompanying box that is intended to store and display the personal ornament in an attractive manner. Conventional personal ornament boxes often feature a clam-shell design with a hinge connecting a first segment and a second segment. The hinge is typically equipped with a means for biasing the first segment and the second segment together in a closed configuration and a means for biasing the first segment and the second segment apart in an open configuration. Generally, the closed configuration is used for storing the personal ornament, and the open configuration is used for displaying the personal ornament. The act of switching the personal ornament box between the closed configuration and the open configuration is often an important part of presenting a personal ornament, and yet conventional personal ornament boxes are not configured to accentuate this act. In short, they do little to draw attention to their contents during presentation. Personal ornament boxes that include mechanical arrangements to present their contents in more sophisticated manners have been proposed, but such boxes are often bulky, unreliable, expensive, unattractive, and/or overly complex. Accordingly, there exists an unmet need for personal ornament boxes that address one or more of these limitations.

SUMMARY

Some embodiments of the present disclosure relate to an apparatus, which is also referred to herein as a container. The container is for presenting and storing an object. The container comprises a base and a shell. The shell has a first end and second end and the first end is operatively couplable to the base so that the shell is rotatable relative to the base about a central axis. The second end defines an aperture about the central axis opposite to the base. The container also includes a carriage that is receivable within the shell and the carriage is configured to translate between a presentation position proximal to the aperture and a storage position distal to the aperture. The container also includes an actuatable member that is positionable adjacent to the aperture and which is configurable between an open position and a closed position. Rotation of the base relative to the shell, in a first direction, drives the actuatable member towards the open position and the carriage towards the presentation position. Rotation of the base relative to the shell, in a second direction, drives the actuatable member towards the closed position and the carriage towards the storage position.

Some embodiments of the present disclosure relate to a container according to the present disclosure further comprising a central member which is received within the shell.

Some embodiments of the present disclosure relate to a container according to the present disclosure, wherein the central member has a first surface which defines a plurality of tracks.

Some embodiments of the present disclosure relate to a container according to the present disclosure, wherein the actuatable member comprises a plurality of aperture blades and wherein an aperture blade of the plurality of aperture blades has a first projection and a second projection.

Some embodiments of the present disclosure relate to a container according to the present disclosure, wherein the first projection is rotatably connected to the shell at a point adjacent to the aperture, and wherein the second projection is translatable within a track of the plurality of tracks.

Some embodiments of the present disclosure relate to a container according to the present disclosure, wherein the central member further comprises a sidewall which defines an inclined slot.

Some embodiments of the present disclosure relate to a container according to the present disclosure, wherein the carriage translation mechanism further comprises: (i) a channel member which is connected to an interior surface of the shell, and which defines a channel; and (ii) a pin having a first end and a second end.

Some embodiments of the present disclosure relate to a container according to the present disclosure, wherein the pin extends through the inclined slot, wherein the first end of the pin is translatable within the channel, and wherein the second end of the pin is connected to the carriage.

Some embodiments of the present disclosure relate to a container according to the present disclosure, wherein the shell further comprises a surface with a chamfered edge which defines the aperture.

Some embodiments of the present disclosure relate to a container according to the present disclosure, wherein the personal ornament is a ring.

Some embodiments of the present disclosure relate to a container according to the present disclosure, wherein the shell and the base are each independently $C_n$-symmetric about an axis which is orthogonal to the aperture.

Some embodiments of the present disclosure relate to a container according to the present disclosure, wherein the shell is wood.

Some embodiments of the present disclosure relate to a container according to the present disclosure, wherein the shell is aluminum.

Some embodiments of the present disclosure relate to use of a container according to the present disclosure for presenting or storing a personal ornament.

Some embodiments of the present disclosure relate to a method of presenting an object from a container having a base and a shell which defines an aperture, the method comprising the steps of: opening an actuatable member adjacent to the aperture; and translating a carriage from a storage position distal to the aperture to a presentation position proximal to the aperture so that at least a part of the personal ornament passes through, or is visible through, the aperture.

Some embodiments of the present disclosure relate to a method according to the present disclosure, wherein the opening of the actuatable member and the translating of the carriage are driven by rotation of the base relative to the shell.

Some embodiments of the present disclosure relate to a method of storing an object in a container having a base and a shell which defines an aperture, the method comprising: translating a carriage from a presentation position proximal to the aperture to a storage position distal to the aperture; and closing a actuatable member adjacent to the aperture to occlude viewing of the personal ornament via the aperture.

Some embodiments of the present disclosure relate to a method according to the present disclosure, wherein the translating of the carriage and the closing of the actuatable member are driven by rotation of the base relative to the shell.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

FIG. 1 shows one embodiment of an apparatus according to the present disclosure for presenting and storing an object, such as a personal ornament, wherein an actuatable member is in a closed position. FIG. 1A and FIG. 1B show the apparatus from upper-preferential and lower-preferential perspectives, respectively. FIG. 1C and FIG. 1D show the apparatus from top and bottom plan views, respectively.

FIG. 2 shows the apparatus of FIG. 1, wherein the actuatable member is in an open position. FIG. 2A and FIG. 2B show the apparatus from upper-preferential and lower-preferential perspectives, respectively. FIG. 2C and FIG. 2D show the apparatus from top and bottom plan views, respectively.

FIG. 3 shows a shell of the apparatus of FIG. 1. FIG. 3A shows an upper-preferential perspective of the shell in an upright orientation. FIG. 3B shows an upper-preferential perspective of the shell in an inverted orientation. FIG. 3C and FIG. 3D show top plan views of the shell in the upright and inverted orientations, respectively. FIG. 3E shows the shell from a profile view.

FIG. 4 shows a central member of the apparatus of FIG. 1. FIG. 4A and FIG. 4B show the central member from upper-preferential and lower-preferential perspectives, respectively. FIG. 4C and FIG. 4D show the central member from top and bottom plan views, respectively. FIG. 4E and FIG. 4F show opposing profile views of the central member.

FIG. 7 shows mid-line, cross-sectional views of the apparatus of FIG. 1. FIG. 7A shows the actuatable member in the closed position and the carriage in the storage position. FIG. 7B shows the actuatable member in the open position and the carriage in the presentation position.

DETAILED DESCRIPTION

Figure 5:
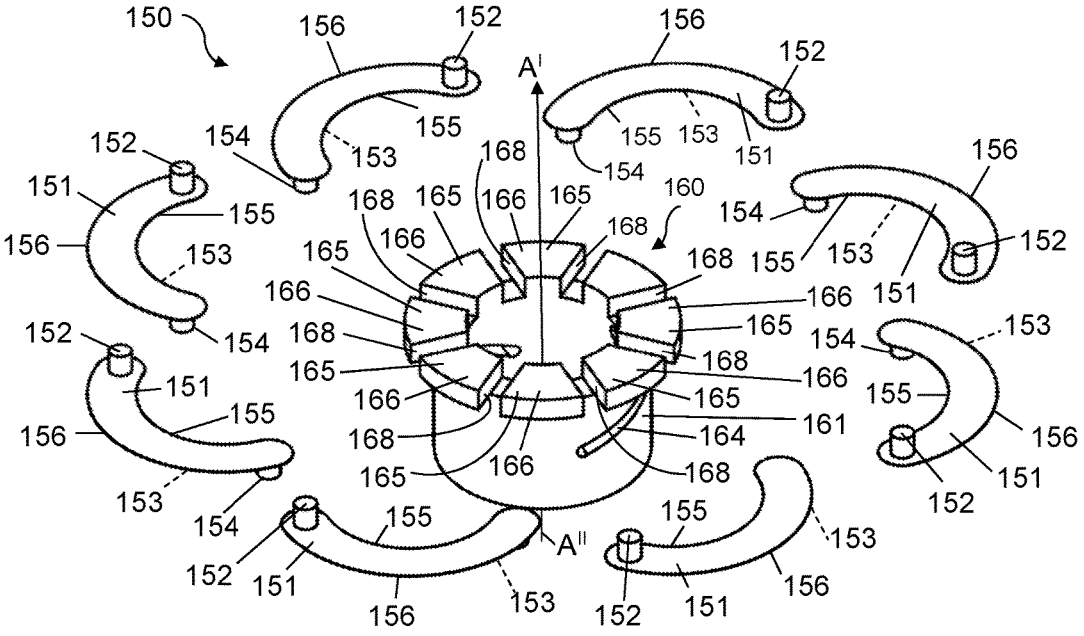
FIG. 5 shows the central member and aperture blades of the apparatus of FIG. 1 from an upper-preferential perspective, wherein the aperture blades are exploded apart.

Embodiments of the present disclosure relate to an apparatus, referred to herein as a container. The container can store an object, such as a personal ornament, on a moveable carriage. The container can be moved between a first position and a second position. In the first position, the carriage is in a storage position that is lowered within the container and an actuatable member of the container is closed. In the second position the carriage moves to a presentation position that is raised relative to the storage position and the actuating member of the container opens to reveal, or permit the passage therepast of, the carriage.

Embodiments of the present disclosure will now be described by reference to FIG. 1 through FIG. 7, which show representations of an apparatus according to the present disclosure.

FIG. 1 shows an apparatus, referred to herein as a container 100, which defines a central axis A'-A" (see FIG. 1A). The container 100 has a base 190 and a shell 110 that is operatively coupled at one end to the base 190. The container 100 houses a carriage 130 within the shell 110 and the carriage 130 is configured to be moveable therein. The shell 110 comprises an annulus 111 with an exterior surface 112, an outer edge 115, and an inner edge 116 (as best seen in FIG. 1A and FIG. 1C). The exterior surface 112 represents the upper-most surface of the shell 110 in the upright position of FIG. 1A. The inner edge 116 defines an aperture 117 through which the object (not shown) can be presented. The inner edge 116 may be chamfered to facilitate access to the object at or near the aperture. As best seen in FIG. 1A and FIG. 1B, the shell 110 has a sidewall 118 which has an outer surface 119 and a lower edge 121 that is positioned proximal the base 190.

The container 100 has a base 190. As best seen in FIG. 1B, the base 190 has a sidewall 191 and an exterior surface 196. The exterior surface 196 represents the lowest surface of the container 100 in the upright position. The base 190 is operatively coupled to the shell 110 and these two components are rotatable relative to each other. For example, a user can rotate the base 190 relative to the shell 110 by grasping the sidewalls 191 and 118 and: rotating the base 190 while holding the shell 110 stationary, rotating the shell 110 while holding the base 190 stationary, or rotating the base 190 and the shell 110 in opposite directions.

The container 100 also includes an actuatable member 101 that comprises moveable aperture blades 150 that can move, preferably in unison, to actuate the actuatable member 101 between an open position and a closed position. The actuatable member 101 is generally $C_8$-symmetric about the central axis A'-A". In FIG. 1, the actuatable member 101 is in a closed position with the aperture blades 150 occluding the aperture (as best seen in FIG. 1A and FIG. 1C). The aperture blades 150 are adjacent to, and generally coplanar with, the annulus 111. The aperture blades 150 have upper surfaces 151 which are coplanar such that the actuatable member 101 forms a generally planar surface in the closed position. In some embodiments of the present disclosure the actuatable member 101 may act as a mechanical iris; however, the present disclosure is not limited to only mechanical iris' that that define a circular aperture.

FIG. 2 shows the container 100 with the actuatable member 101 in the open position. Transitions between the closed position and the open position are driven by rotation of the base 190 relative to the shell 110. In the open position the aperture blades 150 are retracted from the aperture 117.

The container 100 has a carriage 130. As best seen in FIG. 2A and FIG. 2C, when the actuatable member 101 is in the open position, at least a part of the carriage 130 (and the object carried thereon) are visible through the aperture 117.

FIG. 3 shows various views of the shell 110 in both upright and inverted orientations. The shell 110 is generally $C_n$-symmetric about the central axis A'-A". As best seen in FIG. 3B, the sidewall 118 has an inner surface 120 which is concentric with the outer surface 119. Also as best seen in FIG. 3B, the sidewall 118 has a lower edge 121 which is coplanar with, and opposed to, the annulus 111. As best seen in FIG. 3D, the annulus 111 has an interior surface 113 that defines a set of recesses 114 with one recess 114 for receiving and retaining a portion of each aperture blade 150.

The recesses 114 are spaced at equal distances around the circumference of the aperture 117 and are each dimensioned to rotatably retain a projection from the aperture blades 150. The presence of the recesses 114 renders the shell 110 generally $C_8$-symmetric about the central axis A'-A".

Referring to FIG. 4, the container 100 has a central member 160 which is received within the shell 110, and optionally within the base 190, when the container 100 is assembled. As best seen in FIG. 4A and FIG. 4B, the central member 160 has a sidewall 161 with an upper edge 162, a lower edge 163, and a hollow interior. The upper edge 162 and the lower edge 163 are opposed and coplanar. The sidewall 161 defines a pair of inclined slots 164 which are opposed to one another and which extend through the sidewall 161 (as best seen in FIG. 4E and FIG. 4F). The inclined slots 164 are dimensioned to retain pins which are translatable along the lengths of the inclined slots 164. The presence of the inclined slots 164 renders the central member generally $C_2$-symmetric about the central axis A'-A".

The central member 160 further comprises radial wedges 165. The radial wedges 165 have upper surfaces 166 and lower surfaces 167. The upper surfaces 166 are coplanar with the lower surfaces 167 (as best seen in FIG. 4E and FIG. 4F), and they extend beyond the sidewall 161 to form a collar (as best seen in FIG. 4C). The radial wedges 165 have sidewalls 168 which define tracks 169. The tracks 169 extend radially from the intersect between the plane of the radial wedges 165 and the central axis A'-A". The tracks 169 are dimensioned to retain projections from the aperture blades 150.

Referring now to FIG. 5, the aperture blades 150 have inner edges 155 and outer edges 156 which separate upper surfaces 151 from lower surfaces 153. The upper surfaces 151 have upper projections 152 which are dimensioned and positioned to be rotatably retained by the recesses 114 on the interior surface 113 of the annulus 111 of the shell 110 (not shown in FIG. 5, see FIG. 3D). The lower surfaces 153 of the aperture blades 150 have lower projections 154 which are dimensioned and positioned to be translatably retained within the tracks 169 of the central member 160.

Figure 6:
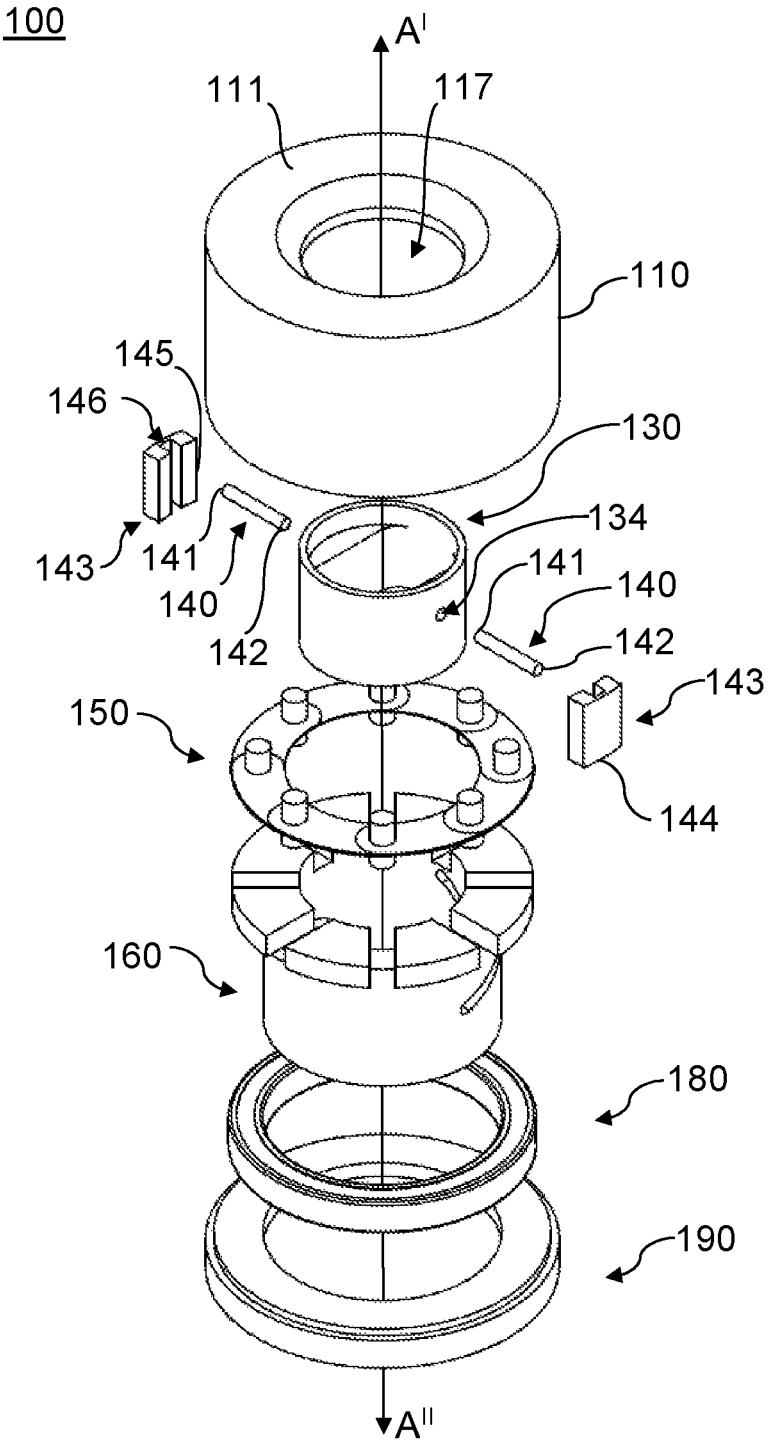
FIG. 6 shows an exploded view of the apparatus of FIG. 1 from an upper-preferential perspective.

Referring now to FIG. 6, the container 100 includes the carriage 130, which is enclosed within the shell 110 and the base 190. The carriage 130 is vertically translatable within the hollow center of the central member 160. The carriage 130 has a sidewall 131 with an upper edge 135 and a lower edge 136. The upper edge 135 and the lower edge 136 are opposed and coplanar. The sidewall 131 has an outer surface 132 and an inner surface 133 which are concentric. A pair of openings 134 are provided in the outer surface 132, and the openings 134 are opposed to one another. The carriage 130 has a compartment 137 for carrying the object. The compartment 137 is generally defined by the inner surface 133 of the sidewall 131.

The container 100 has pair of channel members 143 which are opposed from one another about the central axis A'-A". The channel members 143 have outer surfaces 144 and inner surfaces 145. The outer surfaces 144 are connectible to the interior surface 113 of the shell 110, such that the channel members 143 and the shell 110 rotate as a single unit. The inner surfaces 145 of the channel members 143 each define a channel 146 which runs parallel to the central axis A'-A".

The container 100 has pair of pins 140 which are opposed from one another about the central axis A'-A" and orthogonal thereto. The pins 140 have inner ends 142 which are dimensioned and positioned to be retained by the openings 134 of the carriage 130. The pins 140 have outer ends 141 which are dimensioned and positioned to be retained by the channels 146 of the channel members 143 such that the pins 140 are vertically translatable within the channels 146 as the carriage 130 is vertically translatable within the central member 160 along the central axis A'-A".

The container 100 has a ball bearing 180, which is enclosed within the shell 110 and the base 190, and which is generally $C_n$-symmetric about the central axis A'-A". The ball bearing 180 has an upper surface 181, a lower surface 182, an inner race 183 and an outer race 184. The inner race 183 is connected to the sidewall 161 of the central member 160 which is connected to an interior surface 192 of the base 190. As such the base 190 and the central member 160 rotate as a single unit. The lower surface 182 is adjacent to a raised lip 193 which defines an inner wall 194 and an outer wall 195 of the base 190. The outer race 184 of the ball bearing 180 is connected to the inner surface 120 of the sidewall 118 of the shell 110. As such, the ball bearing 180 provides for rotation of the shell 110 relative to the base 190 and therefore the central unit 160.

FIG. 7 shows cross-sectional views of the container 100. In FIG. 7A, the actuatable member 101 is in the closed position, and the carriage 130 is in a storage position which is distal to the aperture 117. In FIG. 7B, the actuatable member 101 is in the open position, and the carriage 130 is in a presentation position which is proximal to the aperture 117. When the carriage 130 is in the storage position, the object is enclosed within the container 100. When the carriage 130 is in the presentation position, the object either intersects the aperture 117 or is visible therethrough. The translation of the carriage 130 between the storage position and the presentation position is provided by a carriage translation mechanism.

Having set out components of the container 100, the mechanism by which rotation of the base 190 relative to the shell 110 drives the actuatable member 101 between the open position and the closed position will now be described. Referring to FIG. 5 as viewed along the central axis from A' to A", rotation of the shell 110 (not shown in FIG. 5) in a counter-clockwise direction translates the upper projections 152 in a counter-clockwise arc due to their retention within the recesses 114. This provides for translation of the lower projections 154 along the tracks 169 towards the central axis A'-A", thereby driving the actuatable member 101 towards the closed position. Likewise, rotation of the shell 110 (not shown in FIG. 5) in a clockwise direction translates the upper projections 152 in a clockwise arc. This provides for translation of the lower projections 154 along the tracks 169 away from the central axis A'-A", thereby driving the actuatable member 101 towards the open position.

Having set out components of the container 100, the mechanism by which rotation of the base 190 relative to the shell 110 drives translation of the carriage 130 between the storage position and the presentation position will now be described. Referring to FIG. 6, rotation of the shell 110 rotates the channel members 143 due to the connection between the outer surfaces 144 and the inner surface 120. This provides for rotation of the pins 140 about the central axis A'-A" due to the retention of the outer ends 141 within the channels 146. The pins 140 extend through the inclined slots 164 of the central member 160. As the central member 160 is connected to the base 190, the rotation of shell 110 relative to the base 190 provides for translation of the pins 140 along the inclined slots 164. The slope of the inclined slots 164 results in a vertical translation of the pins 140, and this translation is accommodated by the vertical orientation of the channels 146 of the channel members 143. As the inner ends 142 of the pins 140 are retained within the openings 134 of the carriage 130, the rotation of the pins 140 (as provided by rotation of the shell 110) provides for the vertical translation of the carriage 130 within the central member 160. As such, the rotation of the shell 110 relative to the base 190 provides for the translation of the carriage 130 between the storage position and the presentation position, thereby providing the carriage translation mechanism.

Referring to FIG. 6 as viewed along the central axis from A' to A", rotating the shell 110 in a first direction can move the carriage 130 either upwardly or downwardly and rotating the shell 110 in a second direction moves the carriage 130 in the opposite direction. For example, in some embodiments of the present disclosure rotating the shell 110 in a counter-clockwise direction translates the pins 140 along a counter-clockwise arc. This provides for translation of the pins 140 in an upward path along the inclined slots 164 and the channels 146 which moves the carriage 130 towards the presentation position. Likewise, rotation of the shell 110 in a clockwise direction translates the pins 140 along a clockwise arc. This provides for translation of the pins 140 in a downward path along the inclined slots 164 and the channels 146 which moves the carriage 130 towards the storage position. As will be appreciated by one skilled in the art, the present disclosure also contemplates other embodiments of the container 100 where rotation of the shell 110 in counter-clockwise direction translates the pins 140 in a downward path along the inclined slots 164 to bring the carriage 130 towards the storage position. Similarly, rotation of the shell in the clockwise direction translates the pins 140 along a counter-clockwise arc and the pins 140 in an upward path along the inclined slots 164 to bring the carriage 130 towards the presentation position.

In summary, the container 100 is an embodiment of an apparatus for presenting and storing a personal ornament according to the present disclosure. Of course, there are many variations on the container 100 that fall within the scope of the claims. Likewise, there are many alternate embodiments of apparatus for presenting and storing personal ornaments that fall within the scope of the claims. A non-limiting set of variations and alternate embodiments will now be described.

The container 100 can be configured to store and present numerous types of objects. For example, the container 100 can be configured to store and present personal ornaments such as finger rings, toe rings, earrings, arm rings, or combinations thereof. Rings are only one type of personal ornament, and embodiments can be configured to store and present other types of personal ornaments such as necklaces, bracelets, brooches, pendants, jewels, watches, pens, other elongate personal ornaments, or combinations thereof. Furthermore, the container 100 can also be used to store and present objects other than personal ornaments.

The shell 110 can be varied in numerous ways. For example, the dimensions of the shell 110 can be varied. The person skilled in the art will appreciate that the dimensions provided include an approximate+/−10% variation from a given value and that such a variation is always included in any given value provided herein, whether or not it is specifically referred to. The height of the shell 110 can be from 20 to 400 mm (preferably from 35 to 100 mm, more preferably from 38 to 80 mm), and the diameter of the shell 110 can be from 30 to 200 mm (preferably from 50 to 140 mm, more preferably from 60 to 150 mm). The material of the shell 110 can be varied. For example, the shell 110 can be comprised of any type of wood, any type of metal, any type of plastic, or a combination thereof. Preferably, the shell 110 is comprised of wood or metal. More preferably, the shell 110 is comprised of walnut wood or aluminum. The exterior of the shell 110 can be adorned with various markings. For example, the exterior of the shell 110 can be adorned with patterns, designs, text, or logos. Likewise, the exterior of the shell 110 can be smooth or textured (so as to be easier to grip). Moreover, the form of the exterior of the shell 110 can be varied. For example, the exterior of the shell 110 can be but is not limited to generally cylindrical, generally rectangular prismatic, or generally cubic when viewed from a top-plan view. Preferably, the exterior of the shell 110 is generally cylindrical. Components of the shell 110—namely the annulus 111 and the sidewall 118—can be integral or non-integral. The form of these components can be varied. For example, the exterior surface 112 of the annulus 111 and the outer surface 119 of the sidewall 118 can be concave or convex and symmetrical or asymmetrical. Likewise, the form of the inner edge 116 of the shell 110 can be varied. For example, the inner edge 116 can be chamfered or beveled to facilitate access to a personal adornment at (or adjacent to) the aperture 117. The circumference of the inner edge 116 can be varied to provide varying size to the aperture 117. For example, in an embodiment for storing and presenting a finger ring, the circumference of the inner edge 116 can be from 20 to 70 mm (preferably from 25 to 50 mm, more preferably from 30 to 40 mm). Likewise, in an embodiment for storing and presenting a watch, the circumference of the inner edge 116 can be from 50 to 140 mm (preferably from 60 to 120 mm, more preferably from 70 to 100 mm). The dimensions of the recesses 114 in the annulus 111 can be varied provided they rotationally retain the upper projections 152 of the aperture blades 150. For example, the diameter of the recesses 114 can be from 1 to 10 mm (preferably from 2 to 8 mm, more preferably from 4 to 6 mm). The number of recess 114 in the annulus 111 can be varied provided there are sufficient recesses 114 to retain the upper projections 152. For example, the number of recesses 111 can be from 2 to 24 (preferably from 4 to 12, more preferably 8).

The carriage 130 can be varied in numerous ways. For example, the dimensions of the carriage 130 can be varied. The height of the carriage 130 can be from 15 to 350 mm (preferably from 18 to 80 mm, more preferably from 20 to 70 mm), and the diameter of the carriage 130 can be from 10 to 250 mm (preferably from 20 to 120 mm, more preferably from 25 to 100 mm). The material of the carriage 130 can be varied. For example, the carriage 130 can be comprised of any type of wood, any type of metal, any of type plastic, or a combination thereof. Preferably, the carriage 130 is made from wood or metal. More preferably, the carriage 130 is comprised of walnut wood or aluminum. The form of the carriage 130 can be varied. For example, the carriage 110 can be generally cylindrical, generally rectangular prismatic, or generally cubic. Preferably, the carriage 130 is generally cylindrical. Components of the carriage 130—namely the sidewall 131 and the compartment 137—can be integral or non-integral. The form of these components can be varied. For example, the sidewall 131 and the compartment 137 can be concave or convex and symmetrical or asymmetrical. The diameter of the sidewall 131 and the compartment 137 can be varied to accommodate personal ornaments of various dimensions. For example, in an embodiment for storing and presenting a finger ring, the diameter of the sidewall 131 and/or the compartment 137 can be from 20 to 45 mm (preferably from 25 to 40 mm, more preferably from 30 to 38 mm). Likewise, in an embodiment for storing and presenting a watch, the diameter of the sidewall 131 and the compartment 137 can be from 60 to 140 mm (preferably from 70 to 120 mm, more preferably from 75 to 100 mm). The dimensions of the openings 134 in the sidewall 131 can be varied provided they retain the inner ends 142 of the pins 140. For example, the diameter of the openings 134 can be from 1 to 10 mm (preferably from 2 to 5 mm, more preferably from 2.5 to 3.5 mm). The number of openings 134 in the sidewall 131 can be varied provided there are sufficient numbers to retain the inner ends 142 of the pins 140. For example, the number of openings 134 can be from 1 to 10 (preferably from 2 to 4, more preferably 2).

The channel members 143 can be varied in numerous ways. For example, the dimensions of the channel members 143 can be varied. The height of the channel members 143 can be from 5 to 350 mm (preferably from 8 to 120 mm, more preferably from 10 to 70 mm), the width of the channel members 143 can be from 1 to 20 mm (preferably from 2 to 10 mm, more preferably from 3 to 8 mm), and the length of channel members 143 can be from 4 to 50 mm (preferably from 5 to 20 mm, more preferably from 8 to 15 mm). The material of the channel members 143 can be varied. For example, the channel members 143 can be comprised of any type of wood, any type of metal, any type of plastic, or a combination thereof. Preferably, the channel members 143 are comprised of metal. More preferably, the channel members 143 are at least partially made of acrylonitrile butadiene styrene plastic (ABS), aluminum or combinations thereof. The dimensions of the channels 146 of the channel members 143 can be varied provided they retain the outer ends 141 of the pins 140 to translate rotational motion from the shell 110 to the pins 140, and provided they allow for vertical translation of the outer ends 141 within the channels 146. The channel members 146 can be integral or non-integral to the shell 110.

The pins 140 can be varied in numerous ways. For example, the dimensions of the pins 140 can be varied provided: the outer ends 141 are translatably retained by the channels 146 of the channel members 143, the inner ends 142 are retained by the openings 134 of the carriage 130, and the pins 140 are translatable within the inclined slots 164 of the central member 160. The length of the pins 140 can be from 4 to 140 mm (preferably from 10 to 30 mm, more preferably from 12 to 20 mm), and the diameter of the pins 140 can be from 0.5 to 20 mm (preferably from 1 to 10 mm, more preferably from 2 to 5 mm). The material of the pins 140 can be varied. For example, the pins 140 can be comprised of any type of wood, any type of metal, any type of plastic, or a combination thereof. Preferably, the pins 140 are comprised of metal. More preferably, the pins 140 are made at least partially of stainless steel, aluminum or combinations thereof. The number of pins 140 can be varied, provided a sufficient number of pins 140 are present to transfer motion from the shell 110 to the carriage 130 via the channel members 143. For example, the number of pins 140 can be from 1 to 10 (preferably from 2 to 4, more preferably 2).

The aperture blades 150 can be varied in numerous ways. For example, the dimensions of the aperture blades 150 can be varied. The thickness of the aperture blades 150 can be from 0.01 to 3 mm (preferably from 0.05 to 0.2 mm), and the length of the aperture blades 150 can be from 15 to 200 mm (preferably from 20 to 150 mm, more preferably from 50 to 120 mm). The material of the aperture blades 150 can be varied. For example, the aperture blades 150 can be comprised of any type of wood, any type of metal, any type of plastic, or a combination thereof. Preferably, the aperture blades 150 are made at least partially of stainless steel, aluminum or combinations thereof. The upper surfaces 153 of the aperture blades 150 can be adorned with various markings. For example, the upper surfaces 153 can be adorned with patterns, designs, text, or logos. Moreover, the form of the aperture blades 150 can be varied provided they cooperate to form the actuatable member 101 and permit actuating between the open and closed positions of the actuatable member 101. Components of the aperture blades 150—namely the upper projections 152 and the lower projections 154—can be integral or non-integral. The dimensions of these components can be varied provided that the upper projections 152 are rotatably retained by the recesses 114 of the shell 110 and provided that the lower projections 154 are translatably retained by the tracks 169 of the central member 160. For example, the height of the upper projections 152 can be from 1 to 20 mm (preferably from 2 to 10 mm, more preferably from 3 to 6 mm), and the diameter of the upper projections 152 can be 1 to 20 mm (preferably from 2 to 10 mm, more preferably from 3 to 6 mm). Likewise, the height of the lower projections 154 can be from 1 to 20 mm (preferably from 2 to 10 mm, more preferably from 3 to 6 mm) and the diameter of the lower projections can be from 1 to 20 mm (preferably from 2 to 10 mm, more preferably from 3 to 6 mm).

The central member 160 can be varied in numerous ways. For example, the components of the central member 160—namely the sidewall 161 and the radial wedges 165—can be integral or non-integral. The dimensions of these components can be varied provided they are sufficiently small to be enclosed by the shell 110 and the base 190 while providing sufficient room for the channel members 143, the pins 140, and the carriage 130. For example, the height of the sidewall 161 of central member 160 can be from 10 to 300 mm (preferably from 20 to 120 mm, more preferably from 25 to 80 mm), and the outer diameter of the sidewall 161 can be from 15 to 260 mm (preferably from 25 to 140 mm, more preferably from 40 to 120 mm). Likewise, the height of the radial wedges 165 of central member 160 can be from 1 to 20 mm (preferably from 2 to 10 mm, more preferably from 3 to 6 mm, and the outer diameter of the radial wedges 165 can be from 20 to 280 mm (preferably from 30 to 150 mm, more preferably from 45 to 130 mm). The inner diameters of the sidewall 161 and the radial wedges 165 can be varied. For example, in an embodiment for storing and presenting a finger ring, the inner diameter of the sidewall 161 and the radial wedges 165 can be from 20.2 to 45.2 mm (preferably from 25.2 to 40.2 mm, more preferably from 30.2 to 38.2 mm). Likewise, in an embodiment for storing and presenting a watch, the inner diameter of the sidewall 161 and the radial wedges 165 can be from 60.2 to 140.2 mm (preferably from 70.2 to 120.2 mm, more preferably from 75.2 to 100.2 mm). The material of the central member 160 can be varied. For example, the central member 160 can be comprised of any type of wood, any type of metal, any of type plastic, or a combination thereof. Preferably, the central member 160 is comprised of metal. More preferably, the central member 160 is comprised of aluminum. The form of the inclined slots 164 in the sidewall 161 can be varied. For example, the slope of the inclined slots 164 can be from 1 to 89 degrees (preferably from 5 to 60 degrees, more preferably from 10 to 55 degrees). The dimensions of the inclined slots 164 can be varied provided they translatably retain the pins 140. For example, the width of the inclined slots 164 can be from 1 to 20 mm (preferably from 1 to 10 mm, more preferably from 1 to 3 mm), and the length of the inclined slots 164 can be from 15 to 816 mm (preferably from 23 to 118 mm, more preferably from 32 to 102 mm). The number of inclined slots 164 can be varied provided a sufficient number is present to translatably retain the pins 140. For example, the number of inclined slots 164 can be from 1 to 10, preferably from 2 to 6, and more preferably 2.

The ball bearing 180 can be varied in numerous ways provided it facilitates rotation of the base 190 relative to the shell 110.

The base 190 can be varied in numerous ways. For example, the dimensions of the base 190 can be varied. The thickness of the base 190 can be from 1 to 300 mm (preferably from 2 to 50 mm, more preferably from 3 to 20 mm), and the diameter of the base 190 can be from 30 to 200 mm (preferably from 50 to 140 mm, more preferably from 60 to 150 mm). The material of the base 190 can be varied. For example, the base 190 can be comprised of any type of wood, any type of metal, any type of plastic, or a combination thereof. Preferably, the base 190 is comprised of wood or metal. More preferably, the base 190 is comprised of walnut wood or aluminum. The exterior of the base 190 can be adorned with various markings. For example, the exterior of the base 190 can be adorned with patterns, designs, text, or logos. Likewise, the exterior of the base 190 can be smooth or textured (so as to be easier to grip). Moreover, the form of the exterior of the base 190 can be varied. For example, the exterior of the base 190 can be generally cylindrical, generally rectangular prismatic, or generally cubic. Preferably the exterior of the base 190 is generally cylindrical. Components of the base 190—namely the sidewall 191, the interior surface 192, and the exterior surface 196—can be integral or non-integral. The form of these components can be varied. For example, the sidewall 191 and the exterior surface 196 can be concave or convex and symmetrical or asymmetrical. Provided that the interior surface 192 is configured to retain the lower edge 163 of the central member 160, the interior surface 192 can be flat or have a raised lip 193 defined by inner wall 194 and outer wall 195. The dimensions of the raised lip 193, the inner wall 194, and the outer wall 195 can be varied. For example, the width of the raised lip 193 can be from 1 to 100 mm (preferably from 2 to 50 mm, more preferably from 5 to 15 mm), the height of the inner wall 194 can be from 0 to 299 mm (preferably from 1 to 49 mm, more preferably from 2 to 19 mm), and the height of the outer wall 195 can be from 0 to 295 mm (preferably from 1 to 20 mm, more preferably from 1 to 5 mm).

I claim:

1. An apparatus for presenting and storing an object, the apparatus comprising:

a base;

a shell with a first end and second end, the first end is operatively couplable to the base so the shell is rotatable relative to the base about a central axis, and the second end defines an aperture about the central axis opposite to the base;

a carriage that is receivable within the shell and that is configured to translate between a presentation position proximal to the aperture and a storage position distal to the aperture; and an actuatable member that is positionable adjacent to the aperture and which is configurable between a closed position in which the actuatable member at least partially occludes the aperture, and an open closed position in which the actuatable member does not occlude at least part of the aperture, wherein, rotation of the base relative to the shell, in a first direction, drives the actuatable member towards the open position and the carriage towards the presentation position, and wherein rotation of the base relative to the shell, in a second direction, drives the actuatable member towards the closed position and the carriage towards the storage position.

2. The apparatus of claim 1 further comprising a carriage-translation mechanism that is within the shell and that comprises a central member that has a first surface that defines a plurality of tracks.

3. The apparatus of claim 2, wherein the actuatable member comprises a plurality of aperture blades each with a first projection and a second projection.

4. The apparatus of claim 3, wherein each of the first projections is rotatably connected to the shell at a point adjacent to the aperture, and wherein each of the second projections is translatable within a track of the plurality of tracks of the central member.

5. The apparatus of claim 2, wherein the central member further comprises a sidewall that defines an inclined slot.

6. The apparatus of claim 5, wherein the carriage translation mechanism further comprises:

a channel member that is connected to an interior surface of the shell, the channel member defines a channel; and a pin having a first end and a second end, wherein the pin extends through the inclined slot, the first end of the pin is translatable within the channel, and wherein the second end of the pin is connected to the carriage.

7. The apparatus of claim 1, wherein the second end of the shell further comprises a chamfered edge that defines the aperture.

8. The apparatus of claim 1, wherein the shell and the base are each independently rotationally symmetric about the central axis.

9. The apparatus of claim 1, wherein the shell is at least partially made of wood.

10. The apparatus of claim 1, wherein the shell is at least partially made of aluminum.

11. Use of the apparatus defined in claim 1 for presenting or storing a personal ornament.

12. A method of presenting an object within an apparatus having a base and a shell which defines an aperture, the method comprising:

opening an actuatable member adjacent to the aperture; and translating a carriage from a storage position distal to the aperture to a presentation position proximal to the aperture so that at least a part of the object passes through, or is visible through, the aperture, wherein the opening of the actuatable member and the translating of the carriage are driven by rotation of the base relative to the shell.

13. A method of storing a personal ornament within an apparatus having a base and a shell which defines an aperture, the method comprising:

translating a carriage from a presentation position proximal to the aperture to a storage position distal to the aperture; and closing an actuatable member adjacent to the aperture to occlude viewing of the personal ornament via the aperture, wherein the translating of the carriage and the closing of the actuatable member are driven by rotation of the base relative to the shell.

* * * * *